US005443258A

United States Patent [19]

Kinsella

[11] Patent Number: 5,443,258

[45] Date of Patent: Aug. 22, 1995

[54] BASKETBALL RETURN DEVICE

[76] Inventor: Kevin G. Kinsella, R.R. 1, Box 29, Cooksville, Ill. 61730

[21] Appl. No.: 350,424

[22] Filed: Dec. 6, 1994

[51] Int. Cl.[6] ..... A63B 69/00

[52] U.S. Cl. ..... 273/1.5 A

[58] Field of Search ..... 273/1.5 A, 396

[56] References Cited

U.S. PATENT DOCUMENTS

| | | | |
|---|---|---|---|
| 2,889,149 | 6/1959 | Williams | 273/396 |
| 3,233,896 | 2/1966 | King | 273/1.5 A |
| 3,446,504 | 5/1969 | Pascucci | 273/1.5 A |
| 3,945,638 | 3/1976 | Luebkeman | 273/1.5 A |
| 4,678,189 | 7/1987 | Koss | 273/1.5 A |
| 5,265,870 | 11/1993 | Merino | 273/1.5 A |

*Primary Examiner*—Paul E. Shapiro
*Attorney, Agent, or Firm*—Philip L. Bateman

[57] ABSTRACT

A basketball return device directs the basketball back to the shooter after he successfully shoots the ball through the rim and net of the basketball goal. The device contains a platform positioned directly under and just below the bottom of the net. The platform has a disk-shaped base which is declined from back to front and an outwardly tapering shoulder extending around the back an arc of about 120° to 300° so that a basketball dropping through the net lands on the platform and rolls off the front in the direction of the shooter.

15 Claims, 2 Drawing Sheets

Fig. 1
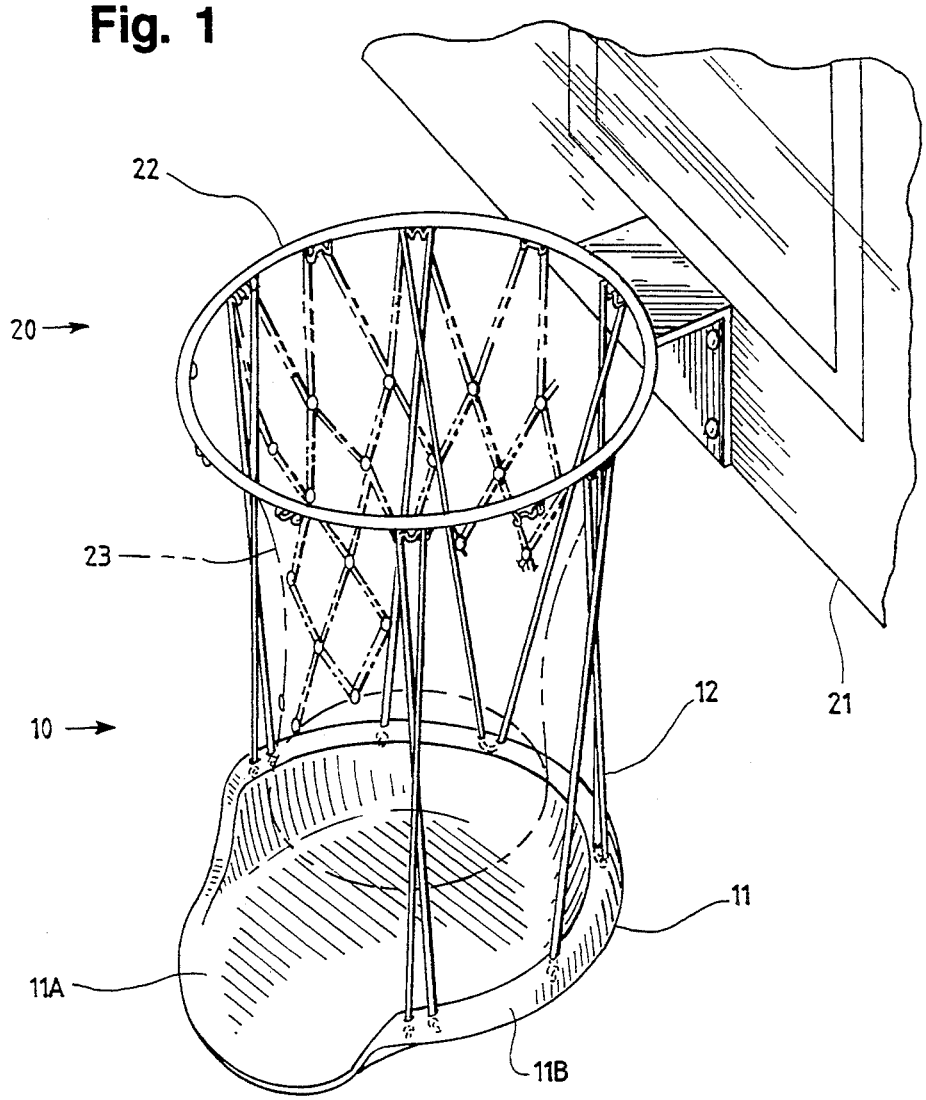
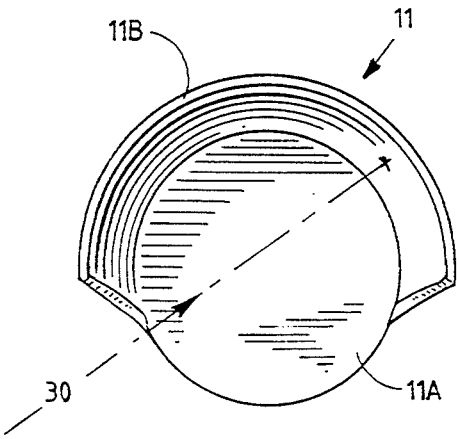
Fig. 2A
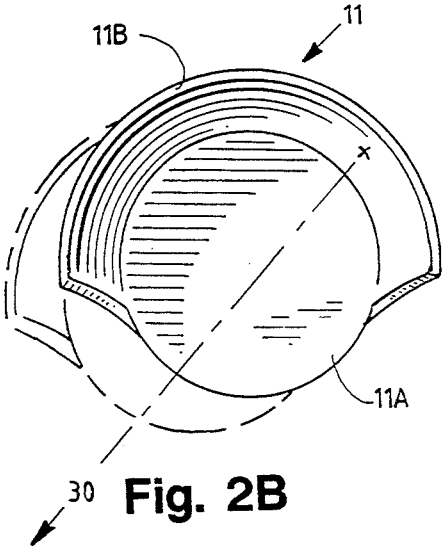
Fig. 2B

BASKETBALL RETURN DEVICE

FIELD OF THE INVENTION

This invention relates to the game of basketball. More particularly, this invention relates to devices for returning the basketball to the shooter.

BACKGROUND OF THE INVENTION

It is widely known that the game of basketball was invented by Dr. James Naismith in 1891 as a means for providing off-season exercise for baseball and football players. Dr. Naismith reportedly climbed a ladder and hammered a bottomless peach basket to a balcony as the first basketball goal. The game of basketball rapidly gained popularity and is now one of the most widely-played games in the United States and the rest of the world.

The bottomless peach basket nailed to a balcony has long since been replaced by a goal consisting of a backboard, a rim, and a net, all of which are mounted on a pole or suspended in some other manner so that the top of the rim is exactly ten feet above the floor of the basketball court. The backboard is a flat, vertical piece of wood, metal, fiberglass, or acrylic plastic having a width of approximately six feet and a ;height of approximately four feet. The primary purposes of the backboard are to enable a-shooter to bank the basketball off the backboard through the rim and to help keep a ball from going out of bounds after a missed shot.

The rim is a circular metal ring having an inside diameter of 18 inches which is mounted horizontally to the lower portion of the backboard. The rim typically contains twelve equally-spaced hooks on its underside for supporting a net. Basketball nets are commonly made of cotton, nylon, or polyethylene cord interconnected in a diamond-shaped pattern to form a funnel. The net has an upper diameter of 18 inches, a lower diameter of about 6 to 10 inches, and a height (length) of about 12 to 18 inches. The net serves several important functions in the game. First of all, it slows the basketball as it passes down through the rim. Secondly, the net changes the trajectory of the ball so that it drops straight down from the goal rather than continuing in the direction it was shot. Thirdly, the net provide a visual aid to a player shooting a basketball. And fourthly, the net improves the ability of referees, players, and spectators to determine when the ball has passed through the rim (i.e., when a "basket" has been made).

While regulation basketball is played with five-man teams on a court with two goals at opposite ends, the game is often played with fewer players and on half courts. The popularity of the game has much to do with this flexibility. The game also has the advantage that its skills can be practiced by a player by himself. Every basketball player of skill has spent countless hours practicing shooting by himself. When a player misses a shot, it can bounce off the rim at virtually any angle about the 180° arc defined by the backboard. Retrieving the ball takes time and reduces the amount of shots a player can practice in a given amount of time. Even if the player makes a shot, the player must usually move to retrieve the ball. Accordingly, it would be desirable if the ball would return to the player when a basket is made during shooting practice.

A large number of devices have been disclosed which attach to the rim and direct a basketball in one particular direction when a basket is made. Examples of such devices are found in Steele, Jr., U.S. Pat. No. 3,799,543, issued Mar. 26, 1974; Spier, Jr., U.S. Pat. No. 3,814,421, issued Jun. 4, 1974; Kershaw, U.S. Pat. No. 4,706,954, issued Nov. 17, 1987; Farkas, Jr., U.S. Pat. No. 4,720,101, issued Jan. 19, 1988; and Kotlarz, U.S. Pat. No. 4,957,289, issued Sep. 18, 1990. These devices work well if a player wants to practice a shot from one direction, such as free throws. However, a player often likes to practice shooting from a variety of positions on the court. Rather than having the ball returned to one set spot, it would be much better if the ball were returned in the direction it was shot. There has heretofore been no device to accomplish this purpose.

SUMMARY OF THE INVENTION

The general object of this invention is to provide an improved basketball return device. A more particular object is to provide a basketball return device which returns the ball in the direction it was shot when a basket is made. Other objects are to provide such a device which is sturdy, weatherproof, inexpensive, and easy to attach and remove.

I have invented an improved basketball return device for returning a basketball to a player after he successfully shoots the basketball through a rim with a net. The device comprises: (a) a platform adapted to be positioned directly under and a short distance below the bottom of the net, the platform having a disk-shaped base witch a diameter of about 7 to 14 inches which is declined from back to front, the platform also having a substantially horizontal, outwardly tapering shoulder extending around the back of the base through an arc of about 120° to 300° so that a basketball dropping through the net and landing on the platform bounces back toward the shooter and rolls off the front; and (b) a means for fastening the platform in a position directly under and a short distance below the bottom of the net.

The basketball return device of this invention returns the ball to the shooter after a shot is made throughout a wide arc of about 120° to 150°. The device is easy to attach to, and remove from, the basketball goal. The device is sturdy, weatherproof, and inexpensive.

BRIEF DESCRIPTION OF THE DRAWINGS

FIG. 1 is a perspective view of one embodiment of the basketball return device of this invention in position on a conventional basketball goal.

FIG. 2A is a top view of the platform of the basketball return device shown in FIG. 1.

FIG. 2B is a top view of the platform shown in FIG. 2A in a position displaced by contact with a basketball.

DETAILED DESCRIPTION OF THE INVENTION

Figure 3:
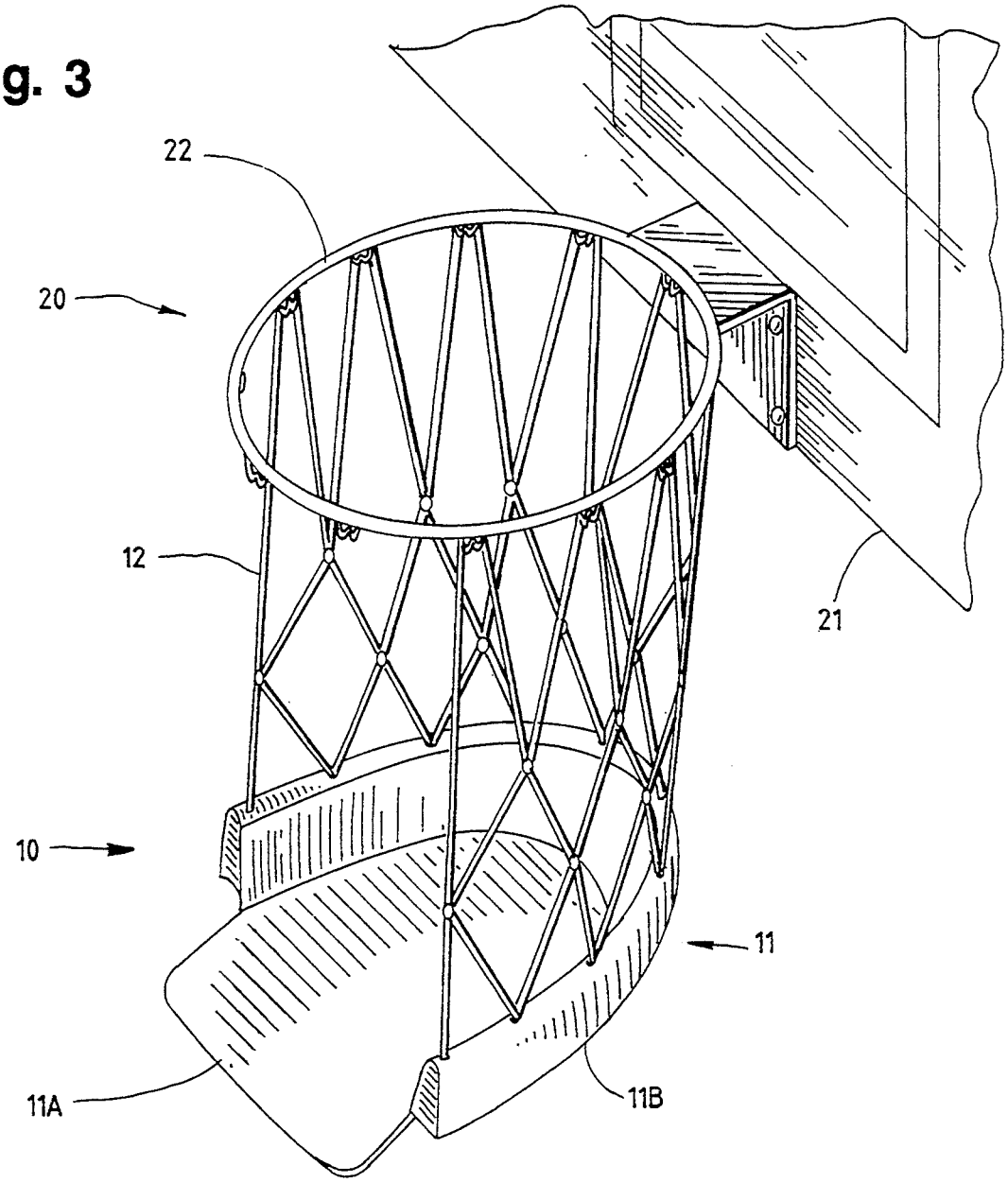
FIG. 3 is a perspective view of a second embodiment of the basketball return device of this invention in position on a conventional basketball goal.

This invention is best understood by reference to the drawings. FIG. 1 shows a basketball return device 10 in position on a conventional basketball goal 20. The basketball goal consists of a backboard 21, a rim 22, and a net 23. The net is shown with phantom lines so that the return device can be seen better.

Figure 4:
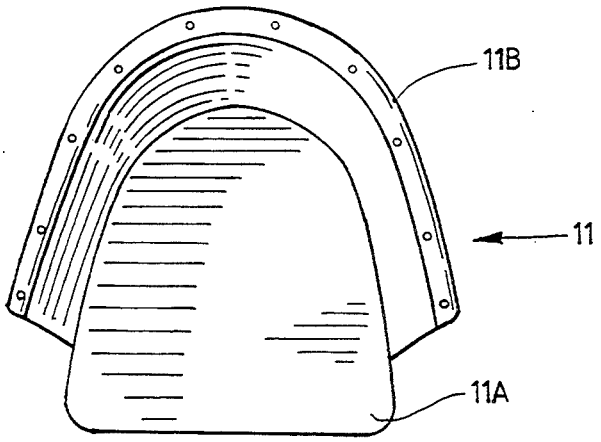
FIG. 4 is a top view of the platform of the basketball return device shown in FIG. 3.

The basketball return device includes a platform 11 positioned directly below the net so that the basketball always drops onto it after passing through the net. The platform is shown alone in FIGS. 2A and 2B. The platform contains a base 11*a* surrounded at the back by a shoulder 11*b*. The base is disk-shaped in that it is relatively flat, relatively thin, and the back of its perimeter is curved (circular, oval, elliptical, or the like). The base has a diameter of about 7 to 14 inches, preferably about 9 to 12 inches, to roughly conform to the size and shape of the basketball. It is declined from back to front so the basketball rolls forward. The amount of slope is typically about 1 to 6 inches from back to front. If the slope is less than about one inch, the basketball does not leave the platform with sufficient speed. If the slope is greater than about six inches, the basketball tends to "break," i.e., change direction as it rolls across the base. Thus, the ball tends to roll off the base at the lowest point and always be returned to a single point. As discussed below, the purpose of the basketball return device is to return the ball to the shooter throughout a wide arc and not to always return the ball to a particular spot. For the same reason, the base is preferably substantially flat (as opposed to being concave or convex) so the ball is not directed in any one particular channel. The front of the base can be curved as shown in FIG. 2 or relatively straight as shown in FIG. 4.

The shoulder rises above the back portion of the platform. The shoulder extends around an arc of about 150° to 300° centered through the front-to-back center line. The shoulder preferably extends around an arc of about 180° to 270°. The top of the shoulder is substantially horizontal to prevent the ball from rolling off the back. The inside of the shoulder tapers outwardly (from bottom to top) so that a ball landing on the inside is propelled back toward the shooter. The taper is preferably about 30° to 75° to the horizon (0° being horizontal and 90° being vertical). Most preferably, the amount of the taper is greatest (steepest) at the edges and least at the center. The height of the shoulder is about 1 to 4 inches at the back and about 3 to 7 inches at each end. The transition between the shoulder and the base is generally gradual so there is no sharp demarcation between the two regions. The edges of the shoulder are optionally flared outward as shown in the FIG. 3 embodiment.

The platform is made of a material sufficiently strong so the basketball does not break or deform it. The material is preferably weatherproof so the device can be mounted on outdoor goals for extended periods of time. Suitable materials include plastics, fiberglass, and metals. Molded plastics such as polypropylene and acrylonitrile-butadiene-styrene (ABS) copolymers are especially preferred because of their low cost and light weight.

Horizontally, the platform is positioned directly below the center of the rim. In other words, if one looked down at the basketball goal from overhead, the center of the rim would be directly over, or nearly directly over, the center of the platform. Vertically, the platform is positioned a short distance below the bottom of the net. The distance between the front bottom of the net and the portion of the platform directly below is about 2 to 8 inches. If this distance is less than about two inches, the basketball is slowed down excessively by the net as it rolls out. If the distance is more than about eight inches, the basketball may pass between the net and the back of the platform rather than being directed onto the platform where it will roll out the front.

The means for fastening the platform in position below the net contains an opening at the front to enable the basketball to roll out. While the platform can be fastened in a rigid position, it is preferred that the platform hang in such a way that it can move forward and backward and from side to side. As explained in detail below, this movement enables the ball return device to return basketballs throughout a wider arc than if the platform were immobile. Typically, the platform is fastened by cords 12 running between the platform and the rim as shown in FIG. 1. Each cord, or section of cord, passes through two holes in the platform's shoulder. The cord is looped through the hooks mounted to the underside of the rim. Alternatively, a hook is attached at the center of the cord and is connected to the net and/or rim. A variety of other fastening means employing hooks, straps, cords, etc. alone or in combination are also suitable. The primary advantage in mounting the basketball return device for use with an existing net is that there is no need to remove the net or to do without the appearance and function of the net. In other words, the return device can be easily added to an existing basketball goal and used when shooting practice is desired or when conventional games are played. If and when it is desired to remove the device from the goal, it is very easily removed.

An alternative means for fastening is shown in FIGS. 3 and 4. In this embodiment, the fastening means takes the place of the net and the net is preferably removed. Although this embodiment requires the net to be removed, it offers the advantage of selecting the speed at which the basketball hits the platform. In the embodiment shown in FIGS. 3 and 4, the fastening means are interlocking cords 12 forming a partially-open cylindrical enclosure between the rim and the platform. This enclosure resembles a portion of a standard basketball net in its interlocking diamond-shaped pattern, but differs in that it is cylindrical, i.e., it does not narrow to form a funnel. Accordingly, the basketball lands on the platform at a greater speed than it would after passing through a standard net. This increased speed at impact causes the ball to be returned at a greater speed as well.

The operation of the basketball return device can be illustrated by assuming a player successfully shoots a basketball into the goal along the dotted line 30 in FIG. 2A (the ball travels downward through the rim, the net, and then onto the platform). When a basketball is shot correctly, backspin on the ball is introduced as it leaves the player's hand. The backspinning continues as the ball passes down through the net. When the basketball lands on the tapered shoulder of the platform at the spot designated with an "X," whatever backspin is still present helps to propel the ball forward along line 30. Furthermore, the momentum of the ball hitting the platform causes the platform itself to move into a position shown in FIG. 2B (the original position of the platform is shown with phantom lines). The backward movement of the platform has the effect of widening the arc throughout which the ball is returned. As seen in FIGS. 2A and 2B, if the platform were immobile and the ball landed at the "X" spot, it would be returned along the dotted line and would hit the edge of the shoulder, thus altering its return direction. But with the platform moving backward as shown, the path back to the shooter is unimpeded. The ball drops off the platform with the momentum it gathered rolling down the declined platform. The ball then bounces on the playing surface toward the player. Furthermore, even if the returning basketball rolled into the shoulder nearest the shooter, the momentum of the ball is generally sufficient to move the platform so as to displace the shoulder. The ball then continues in the direction of the shooter, although at a reduced speed because of the impact with the shoulder nearest the shooter on its returning path.

It can be seen that the basketball return device returns the basketball in the direction of the shooter throughout a wide arc of up to about 120° or more. This enables a person to practice shooting from different points around most of the court and have the ball returned to him when a shot is made. If the device is centered on the goal so that it faces the middle of the free throw line, the only parts of the court not serviced well are the areas along the two baselines.

I claim:

1. A basketball return device for returning a basketball to a player after he successfully shoots the basketball through a rim with a net, the device comprising:

(a) a platform adapted to be positioned directly under and a short distance below the bottom of the net, the platform having a disk-shaped base with a diameter of about 7 to 14 inches which is declined from back to front, the platform also having a substantially horizontal, outwardly tapering shoulder extending around the back of the base through an arc of about 120° to 300° so that a basketball dropping through the net and landing on the platform bounces back toward the shooter and rolls off the front; and (b) a means for fastening the platform in a position directly under and a short distance below the bottom of the net.

2. The basketball return device of claim 1 wherein the shoulder tapers outward at an angle of about 30° to 75° to the horizon.

3. The basketball return device of claim 2 wherein the base is substantially flat.

4. The basketball return device of claim 3 wherein the base has a diameter of about 9 to 12 inches.

5. The basketball return device of claim 4 wherein the shoulder extends around the back of the base an arc of about 180° to 270°.

6. The basketball return device of claim 5 wherein the base declines about one to six inches from back to front.

7. The basketball return device of claim 6 wherein the platform is made of plastic, fiberglass, or metal.

8. The basketball return device of claim 7 wherein the fastening means comprises cord which is attached to the platform and adapted to be fastened to the rim.

9. A basketball return device for returning a basketball to a player after he successfully shoots the basketball through a rim, the device comprising:

(a) a platform having a disk-shaped base with a diameter of about 7 to 14 inches which is declined from back to front, the platform also having a substantially horizontal, outwardly tapering shoulder extending around the back of the base through an arc of about 120° to 300° so that a basketball dropping through the rim and landing on the platform bounces back toward the shooter and rolls off the front; and (b) a cylindrical net attached at one end to the shoulder of the platform and the other end of which is adapted to be connected to the rim for fastening the platform in a position directly under rim.

10. The basketball return device of claim 9 wherein the shoulder tapers outward at an angle of about 30° to 75° to the horizon.

11. The basketball return device of claim 10 wherein the base is substantially flat.

12. The basketball return device of claim 11 wherein the base has a diameter of about 9 to 12 inches.

13. The basketball return device of claim 12 wherein the shoulder extends around the back of the base an arc of about 180° to 270°.

14. The basketball return device of claim 13 wherein the base declines about one to six inches from back to front.

15. The basketball return device of claim 14 wherein the platform is made of plastic, fiberglass, or metal.

* * * * *